US005182820A

United States Patent [19]

Marks

[11] Patent Number: 5,182,820

[45] Date of Patent: Feb. 2, 1993

[54] NOZZLE MOUNTINGS

[76] Inventor: Kipley R. Marks, 61 St Heliers Bay Rd., Auckland, New Zealand

[21] Appl. No.: 692,896

[22] Filed: Apr. 29, 1991

[30] Foreign Application Priority Data

Mar. 5, 1989 [NZ] New Zealand ..... 228974
Mar. 5, 1990 [AU] Australia ..... 54744/90

[51] Int. Cl.[5] ..... A61H 33/02; A61H 9/00

[52] U.S. Cl. ..... 4/541.4; 4/492; 4/541.6; 239/428.5; 239/414; 128/66

[58] Field of Search ..... 4/541, 542, 543, 492; 128/66; 239/428.5, 579, 416.4, 414, 587.3

[56] References Cited

U.S. PATENT DOCUMENTS 3,612,408 10/1971 Holleman ..... 239/587.3
4,335,854 6/1982 Reynoso ..... 239/428.5
4,349,923 9/1982 Chalberg ..... 4/542
4,416,030 11/1983 Reynoso ..... 4/542 X
4,541,780 9/1985 Moreland ..... 4/542 X
4,542,854 9/1985 Mathis ..... 4/492 X
4,593,420 6/1986 Tobias et al. ..... 4/541 X
4,671,463 6/1987 Moreland et al. ..... 239/428.5
4,982,459 1/1991 Henkin et al. ..... 4/542 X
5,014,372 5/1991 Thrasher et al. ..... 4/541 X
5,076,500 12/1991 Daniels ..... 239/428.5 X

FOREIGN PATENT DOCUMENTS 2112670 7/1983 United Kingdom ..... 4/542

*Primary Examiner*—William A. Cuchlinski, Jr.
*Assistant Examiner*—John L. Beres
*Attorney, Agent, or Firm*—Jacobson, Price, Holman & Stern

[57] ABSTRACT

A nozzle mounting has a body with air and water passageways including a nozzle member for discharging a mixture of air and water. The nozzle member has outer walls of spherical form surrounding a passageway through the nozzle so that the nozzle may be manually rocked by a user to direct the flow of mixed air and water in a desired direction. Air inlets are provided in the walls of the nozzle so that air from the air passageway in the body is entrained in water passing through the passageway in the nozzle so that the nozzle passageway is not altered in its selected disposition by the discharge of the mixture of air and water through the passageway.

7 Claims, 3 Drawing Sheets

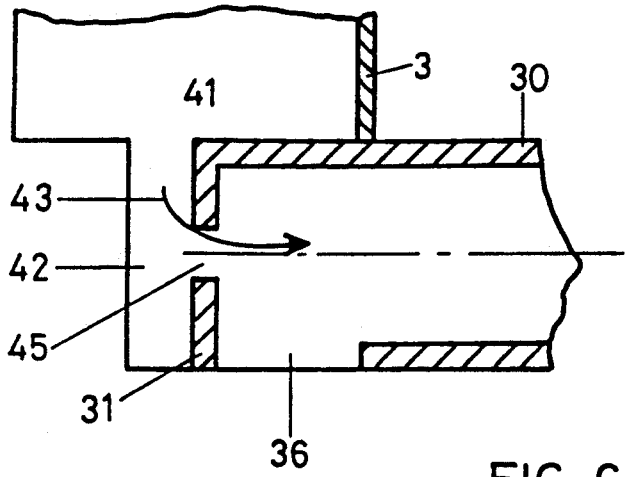
FIG 6
FIG 7
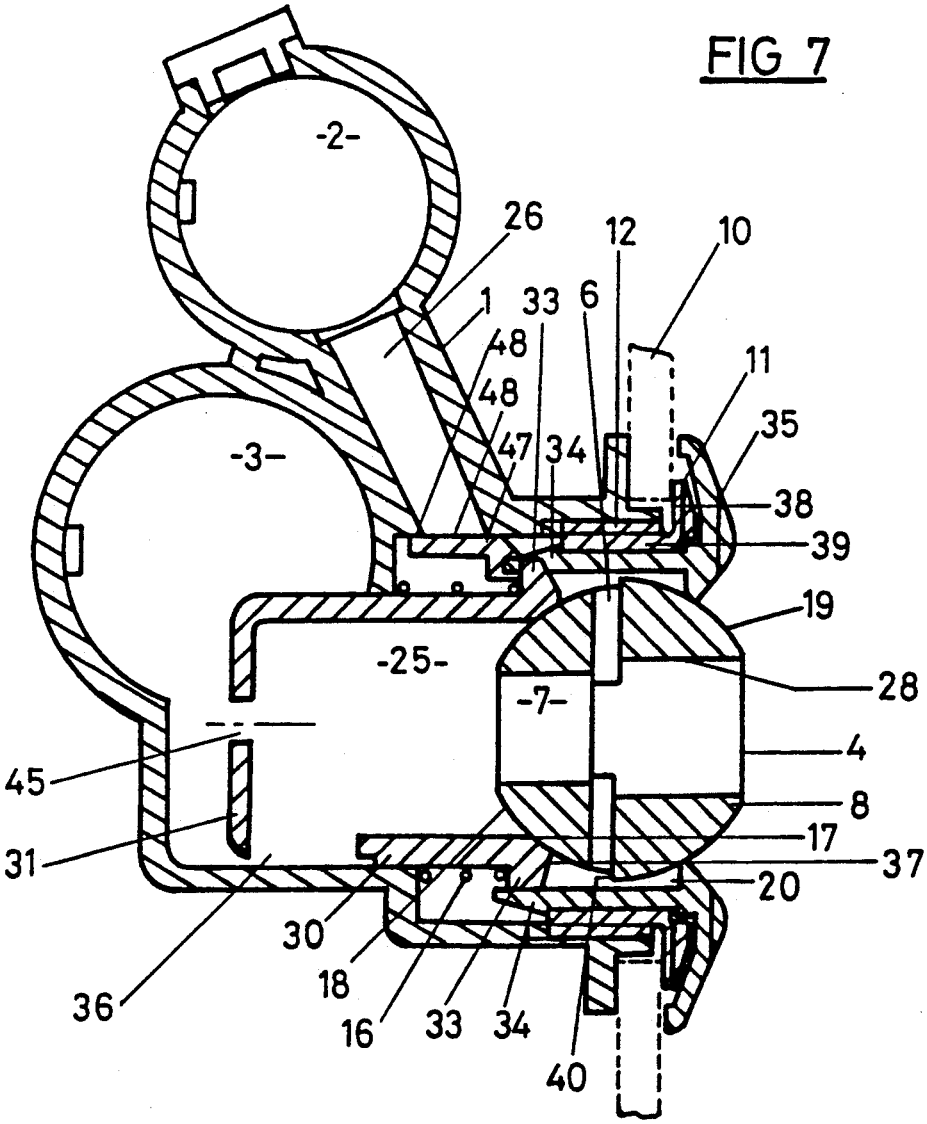

NOZZLE MOUNTINGS

SUMMARY OF THE INVENTION

This invention relates to nozzle mountings and has been devised particularly though not solely for use with the nozzles in spa pools, spa baths and similar installations.

It is an object of the present invention to provide a nozzle mounting which will at least provide the public with a useful choice.

Accordingly the invention consists in a nozzle mounting comprising a body, a main air passageway and a main water passageway in said body, a nozzle member having outer walls of spherical form and a nozzle passageway passing therethrough, a receptacle in said body to receive said nozzle member, retaining means to retain said nozzle member in said body sealing the contact with parts of said outer walls, while permitting manipulative rocking movement of said nozzle member over a range of movement, the nozzle member having at least one water entry for water, at least one air entry for air, and at least one exit for combined water and air, said air entry being open to said main air passageway and said water entry being open to said main water passageway, and fixing means for fixing said body to an opening in a vessel, the construction and arrangement being such that on water entering said nozzle passageway through said water entry air from said main air passageway is entrained in the water from said main water passageway and the combined air and water mixture discharged from said nozzle passageway in a manner such that the disposition of said nozzle passageway is not altered by the discharge of said mixture but said nozzle member may be manually rocked to direct the flow of mixed air and water in a desired direction within said range of movement, while said parts of said outer walls are maintained in contact with said retaining means.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF DRAWINGS

One preferred form of the invention will now be described with reference to the accompanying drawings in which:

FIG. 6 is a diagrammatic part cross section through a spring loaded seal and water inlet in an alternative form of the invention.

FIG. 7 is a cross section through a nozzle mounting representing an alternative form of the invention.

DESCRIPTION OF PREFERRED EMBODIMENTS

Figure 2:
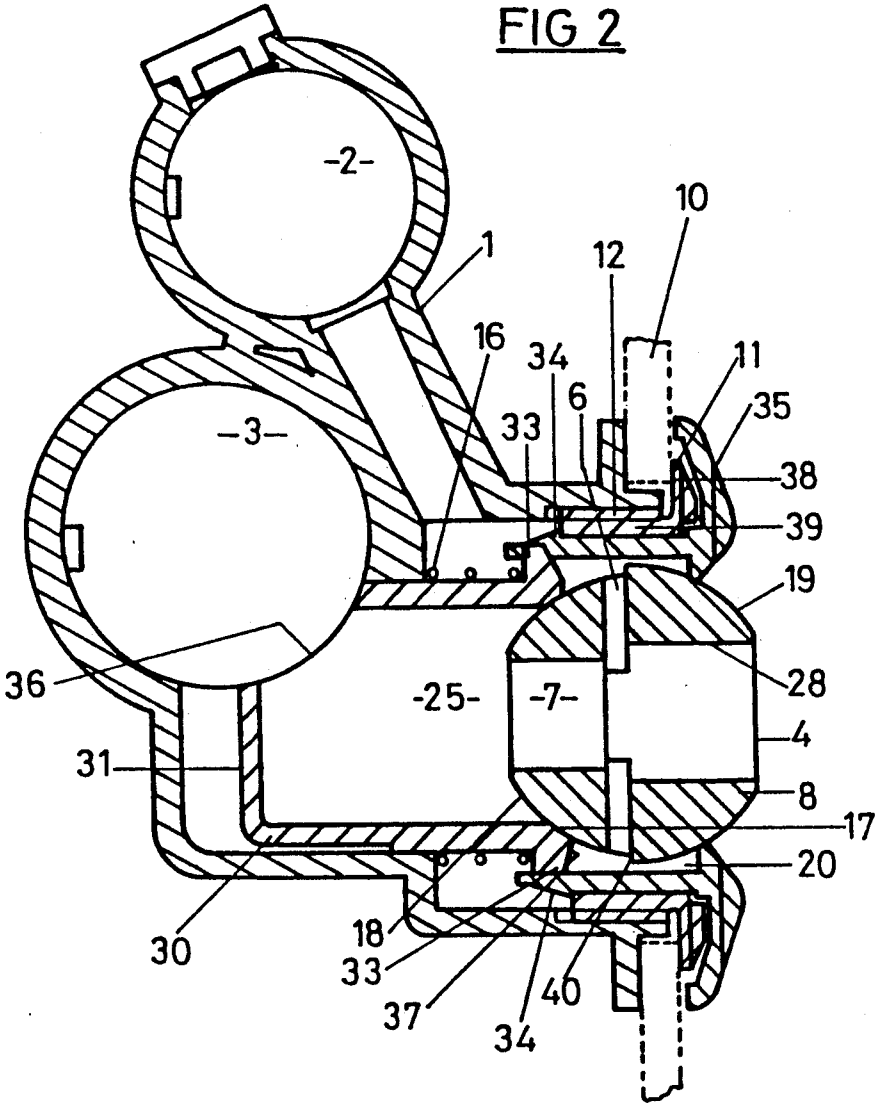
FIG. 2 is a cross section of a modified form of the invention.
Figure 1:
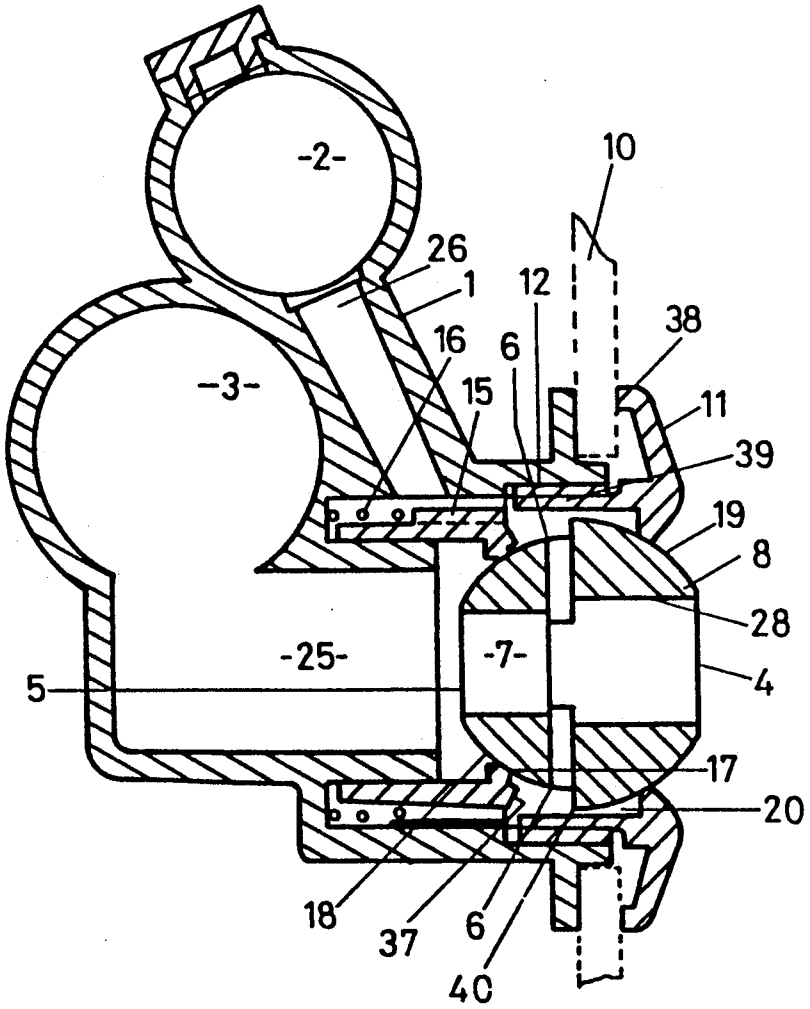
FIG. 1 is a cross section through a nozzle mounting constructed according to the invention.

Referring to the drawings, a main body 1 is provided having a main air passageway 2 for air and a water passageway 3 for water under pressure. Mounted in the main body is a spherical nozzle member 8 having an exit for combined water and air 4, a water entry 5 and air entries 6, the air entries 6 comprising spaced radial slots in the nozzle member (eyeball) 8 which communicate with the water passageway 7. A plurality of water and air entries and exits for combined water and air may also be provided. To hold the main body 1 onto a wall 10, comprising part of a vessel such as a spa pool or spa bath, fixing means comprising a threaded fitting 11 is provided, one part 38 of which is adapted to engage with the wall 10, while another part 39, having a male thread, screws into a corresponding female thread 12 in the main body. Thus the body 1 is secured about the hole in wall 10 by means of fitting 11 which contacts the other side of the hole in wall 10, the co-acting threads ensuring a tight attachment. A sealing collar 15 is spring loaded by a spring 16 positioned between a part of sealing collar 15 and a part of body 1 to press a sealing surface 17 of the collar 15 against a spherical part 18 of the nozzle member 8, making a substantially watertight seal between passages 25 and 26. The sealing collar 15 and the threaded fitting 11 are mounted in a receptacle 20 for the nozzle member 8. The spherical part 18 is of a reduced diameter compared with the spherical part 19 of the nozzle member 8 which creates an annular ledge or shoulder 40 between the two hemispheres.

The reason for this is to prevent rotation past a set limit, defined by contact of ledge 40 with the face 37 of the collar 15 (or collar 30 as in FIG. 2).

The use of the construction will be clear. Water under pressure originating from a pump (not shown) enters through the passageway 3 and the further water passageway 25 to pass into the water entry 5, through the passageway 7 and from the nozzle exit 4. In so doing the water entrains air from passageway 2 through further air passageway 26 into the air entries comprising slots 6, for the air to be entrained in the water, before the air and water mixture exit passageway 7 from the nozzle orifice 4. The nozzle member can be manually positioned to give a desired direction of flow of air and water by inserting a finger or the like into the nozzle orifice and exerting the appropriate force. Positioning of the nozzle member is best achieved by the user rocking the member within the receptacle through the angles of horizontal and vertical rotational movement necessary to achieve the desired spatial position of the member which will direct the jet of combined air and water in the direction the user desires.

It will be seen that because the air and the water pass only directly out of the nozzle orifice 4 there is no realignment force acting on the nozzle member 8. Thus when the nozzle member 8 is manually set to any particular position it will maintain that position, there being no forces tending to alter its position. In present constructions, the air and water are directed or the water only is directed by a further nozzle which directs a stream of water against a wall similar to the wall 28 and this causes the equivalent nozzle member 8 to shift its position.

Thus the present invention provides advantages over the construction previously provided.

Referring now to FIG. 2, in place of the sealing collar 15 which is mounted externally of the passageway 25, a modified sealing collar 30 in the form of a cylindrical sleeve is provided having a portion 31 which extends to the passageway 3.

Figure 3:
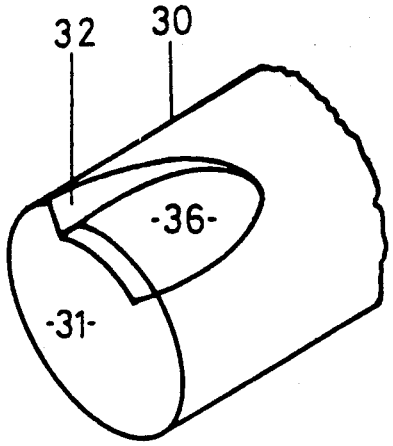
FIG. 3 is a diagrammatic perspective view of part of the spring loaded seal as shown in FIG. 2.

Referring to FIG. 3, the opening in collar 30 defined by end portion 31 and edge surface 32 extends over a substantially semi circular area of collar 30 and is positioned adjacent an opening 41 in water entry 3 leading to water passageway 25. The resulting orifice which allows water to flow through collar 30 is referenced 36. From FIG. 4 it will be seen that a gap 42 exists between end portion 31 of collar 30 and the body 1 of the nozzle mounting.

Figure 4:
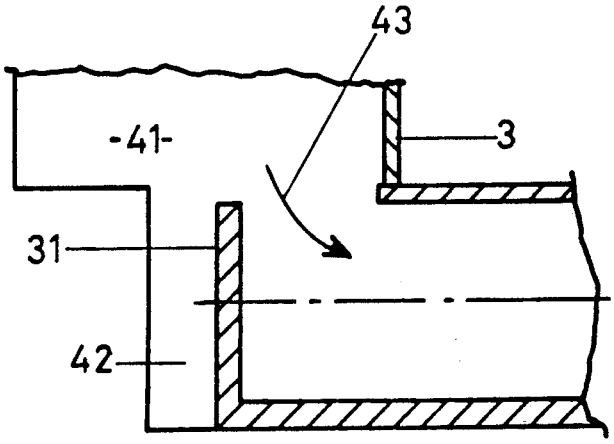
FIGS. 4 and 5 are diagrammatic part cross section through the spring loaded seal and water inlet of FIG. 2.
Figure 5:
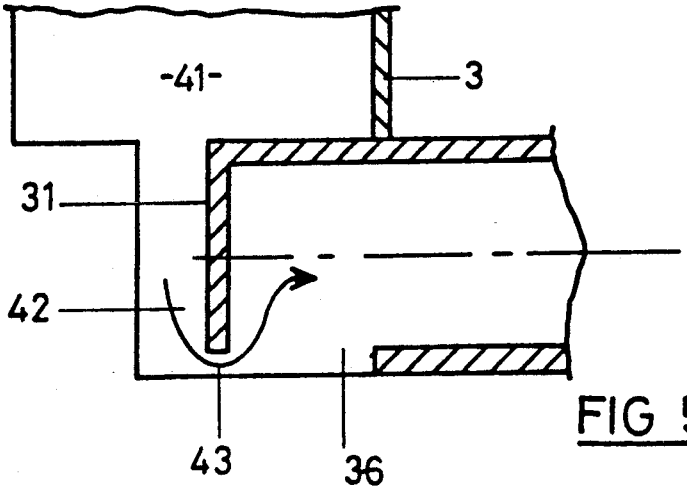

To alter the flow of water through passageways 3 and 25 the collar 30 need only be rotated about its longitudinal axis. Referring to FIG. 4, when the semi circular area 36 is fully open to the opening 41 in water entry 3, the maximum flow rate of water through the passageways exists. As the collar 30 is rotated about its longitudinal axis a decreasing effective area through which water may pass will be open to the opening 41. Thus collar 30 acts as a sleeve valve. Eventually when the collar 30 has been rotated with respect to the position shown in FIG. 4 the collar will be orientated as shown in FIG. 5. Referring to FIG. 5 it can be seen that area 36 is no longer directly open to opening 34. Instead water from passageway 3 flows through gap 42, and then through area 36 into passageway 25. Water flow is generally indicated by arrows 43. In order to clarify the construction FIG. 4 shows collar 30 rotated 180° about its longitudinal axis compared to FIG. 5. In the physical embodiment this is not necessary since the body of the nozzle mounting substantially surrounds the collar 30 such that rotation of collar 30 about its longitudinal axis through an angle sufficient to remove orifice 36 from exposure to water opening 41 will result in minimum water flow.

Alternatively end portion 31 of collar 30 may have a hole 45 in the centre thereof as shown in FIG. 6. Referring to FIG. 6 it will be seen that the edges of end portion 31 are in contact with the body 1 of the nozzle mounting such that when minimum water flows desired, water from water entry 41 must flow through hole 45 in end portion 31 in order to enter collar 30. Semi circular area 36 is still provided as described above as that when collar 30 is rotated with respect to the position shown in FIG. 6, such that the semi circular area 36 is exposed to water entry 41, maximum flow of water in collar 30 will exist.

To provide flow adjustment means rotatable member 35 carries teeth 34 which extend parallel to the axis of rotation of member 35, which thus acts as a crown gear. Teeth 34 engage radial fingers 33 on the end of collar 30 nearest nozzle member 8. The rotatable member 35 may be rotated by a user to rotate collar 30 and thus vary the effective area of orifice 36 exposed to opening 34 in passageway 3, thus varying the flow of water through nozzle member 8 and varying the flow of air and water through orifice 4. There are gaps between teeth 34 and fingers 33 which allow air from main air passageway 2 to enter nozzle air passageway 6.

Referring to FIG. 7 another alternative embodiment is provided, having air flow adjustment means as well as water flow adjustment means. The water flow adjustment means comprise orifice 36 and hole 45 and member 30 as described above. The air flow adjustment means comprise a flap 48 having a securing portion 47 which is used to fasten flap 48 to one or more of the teeth 34 of rotatable member 35. Flap 48 is substantially circular in shape and is in contact with edges 46 of further air passageway 26. In FIG. 7 flap 48 is shown in the closed state, substantially preventing air flow through further air passageway air 26 and air entries 6 and preventing back flow of water through further air passageway 26. Air is still required in air entries 6 of nozzle member 8 to provide a combined flow of water and air at exit 4 even under minimum water flow conditions, therefore flap 48 is of a shape such that air is allowed to flow through further air passageway 26 during minimum water flow conditions. The shape of flap 48 will be determined by the volume of air flow required to provide the desired flow of air and water at exit 4 and will therefore also depend on the shape of orifice 36 in collar 30. If the minimum water flow is desired to be nil, then flap 48 will be configured such that no air flow is present through further air passageway 26 under minimum water flow conditions.

In use an operator will manipulate rotatable member 35 as described above with reference to adjustment of water flow through collar 30 and manual manipulation of rotatable member 35 will also adjust the position of flap 48 with respect to edges 46 of further air passageway 26 via fastening means 47 and teeth 34, thus adjusting the air flow through further air passageway 26. When rotatable member 35 is rotated such that minimum water flow exists, flap 48 will be adjusted with respect to edges 46 of further air passageway 26 such that a suitable minimum air flow also exists to produce a minimum combined flow of air and water. When rotatable member 35 is adjusted such that maximum water flow exists, flap 48 will be in a rotational position such that air flow through further air passageway 26 is not impeded and therefore a maximum combined water and air flow is present at exit 4 of nozzle member 8.

The invention also allows a user to select a desired flow of air from an air entry to the nozzle mounting and therefor a desired flow of combined air and water may be selected.

From the above it can be seen that a nozzle mounting is provided which maintains a mixed flow of air and water in a direction selected by a user. The selected direction of the mixed flow remains unchanged due to the nozzle member incorporating both the air and the water inlets, 6 & 7 respectively thus illuminating the realignment forces which exist in present constructions. The construction of the nozzle member from two hemispheres of different radii with a shoulder between by contact with the stop 37 or 40 limits the directions in which the mixed air and water flow may be set, eliminating the possibility of the cessation of air/water flow through the nozzle which exists in present constructions.

It can also be seen that a nozzle mounting is provided which allows a user to select a desired flow of water from a water entry to the nozzle mounting. Therefore a desired rate of flow of air/water mixture may be selected.

What is claimed is:

1. A nozzle mounting comprising a body, a main air passageway and a main water passageway in said body, a nozzle member having outer walls of spherical form and a nozzle passageway passing therethrough, a receptacle in said body to receive said nozzle member, retaining means to retain said nozzle member in said body sealing the contact with parts of said outer walls, while permitting manipulative rocking movement of said nozzle member over a range of movement, the nozzle member having at least one water entry for water, at least one air entry for air, and at least one exit for combined water and air, said air entry being open to said main air passageway and said water entry being open to said main water passageway, and fixing means for fixing said body to an opening in a vessel, the construction and arrangement being such that on water entering said nozzle passageway through said water entry air from said main air passageway is entrained in the water from said main water passageway and the combined air and water mixture discharged from said nozzle passageway in a manner such that the disposition of said nozzle passageway is not altered by the discharge of said mixture but said nozzle member may be manually rocked to direct the flow of mixed air and water in a desired direction within said range of movement, while said parts of said outer walls are maintained in contact with said retaining means wherein said retaining means comprise a spring loaded seal and a retaining member mounted to retain said nozzle member in said receptacle with said nozzle member held in contact with said retaining member by said spring loaded seal.

2. A nozzle mounting as claimed in claim 1 wherein said spring loaded seal comprises a sealing surface and a rotatable cylindrical sleeve, which sleeve defines a further water passageway, one end of said further water passageway being open to an exit from said main water passageway and said water entry being open to the other end of said further water passageway.

3. A nozzle mounting as claimed in claim 2 wherein water flow adjustment means are provided to adjust the flow of water through said further water passageway.

4. A nozzle mounting as claimed in claim 3 wherein said water flow adjustment means comprises at least one orifice in a part of a surface of said cylindrical sleeve, which orifice may be manually aligned with said exit from said main water passageway by rotation of said cylindrical sleeve about the longitudinal axis of said cylindrical sleeve, the flow of water through said main water passageway being dependent on the extent of alignment of said orifice with said exit from said main water passageway.

5. A nozzle mounting as claimed in claim 2 or claim 3 wherein air flow adjustment means are provided to adjust the flow of air through said air entry.

6. A nozzle mounting as claimed in claim 5 wherein said air flow adjustment means comprises a flap which is located across said air entry, said flap being fastened to or part of a rotatable member which may be manually rotated by a user such that said flap impedes air flow through said air entry dependent on the rotational position of said rotatable member to allow a desired flow of air through said air entry.

7. A nozzle mounting as claimed in claim 6 wherein said rotatable member comprises a part of said cylindrical sleeve such that said cylindrical sleeve may be rotated by a user to adjust the flow of air and water through said nozzle passageway.

* * * * *